United States Patent [19]

Carroll

[11] Patent Number: 5,048,143

[45] Date of Patent: Sep. 17, 1991

[54] TEETHING BRUSH

[76] Inventor: David T. Carroll, 105 Military Rd., Rothchild, Wis. 54474

[21] Appl. No.: 602,170

[22] Filed: Oct. 23, 1990

[51] Int. Cl.[5] ..... A46B 15/00; A61J 17/00

[52] U.S. Cl. ..... 15/110; 15/105; 15/167.1; 606/235; D4/107

[58] Field of Search ..... 606/234, 235, 236; 15/105, 110, 167.1

[56] References Cited

U.S. PATENT DOCUMENTS

| | | | |
|---|---|---|---|
| D. 122,815 | 10/1940 | Crosby | D4/108 |
| D. 229,903 | 1/1974 | Ceniceros | D4/107 |
| 1,826,943 | 9/1931 | Maker | 606/235 |
| 2,121,358 | 6/1938 | Loeffler | 15/167 |
| 2,273,207 | 2/1942 | Kuhn | 15/167 |
| 2,826,201 | 3/1958 | Yoder | 606/235 |
| 3,214,776 | 11/1965 | Bercovitz | 15/26 |
| 3,669,117 | 6/1972 | Herbst | 606/235 |
| 3,720,975 | 3/1973 | Nelson | 15/167 R |
| 3,753,266 | 8/1973 | Ceniceros | 606/235 |
| 4,654,921 | 4/1987 | Dinner | 15/167 R |

FOREIGN PATENT DOCUMENTS

| | | | |
|---|---|---|---|
| 687161 | 2/1953 | United Kingdom | 606/235 |

*Primary Examiner*—Edward L. Roberts
*Assistant Examiner*—Patrick F. Brinson
*Attorney, Agent, or Firm*—Lathrop & Clark

[57] ABSTRACT

A teething brush for an infant or child is disclosed which has a body in the shape of closed ring. The body ring has a forward curved portion which is dimensioned to fit within a child's opened mouth and a rearward curved portion which is wider than a child's opened mouth so as to prevent the body from being inserted fully into a child's mouth. The rearward curved portion forms a handle for gripping by a child and has a plurality of protrusions which extend from the upper and lower surfaces of the rearward portion to form teething bumps for biting engagement with a child's teeth and gums. The teething brush has a brush head formed of a plurality of upstanding bristles which extend from the forward curved portion of the body. The brush head is curved to conform to the curve of the forward body portion. The teething brush has smooth sides and rounded edges and is dimensioned to avoid trauma to a child's throat and mouth to permit unsupervised use by infants and small children.

10 Claims, 2 Drawing Sheets

FIG. 1
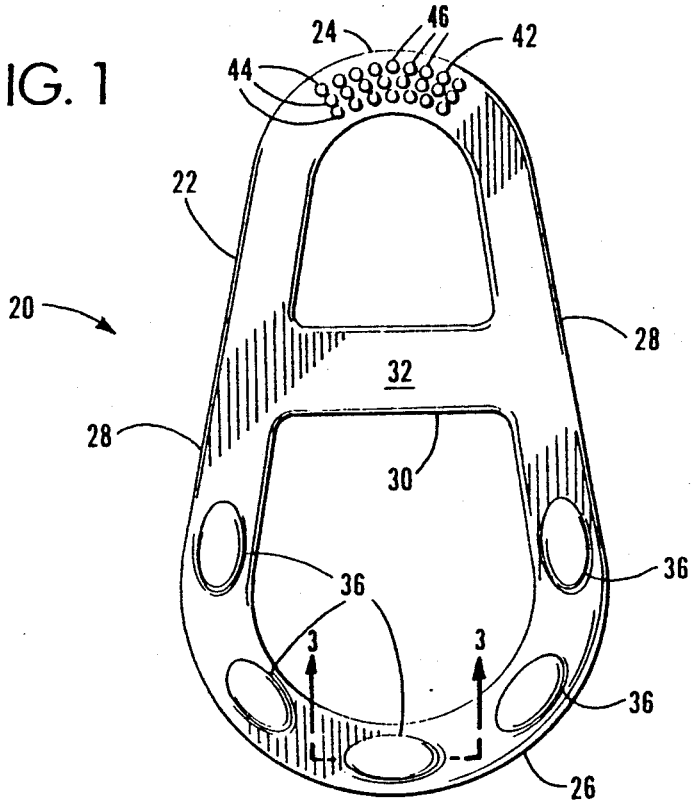
FIG. 2
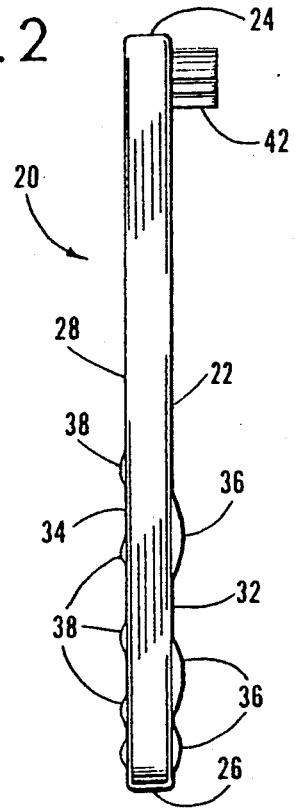
FIG. 3
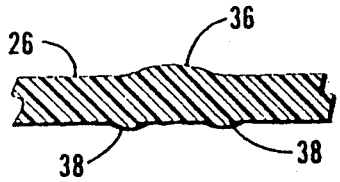
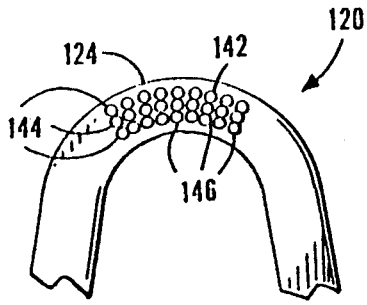
FIG. 5
FIG. 4
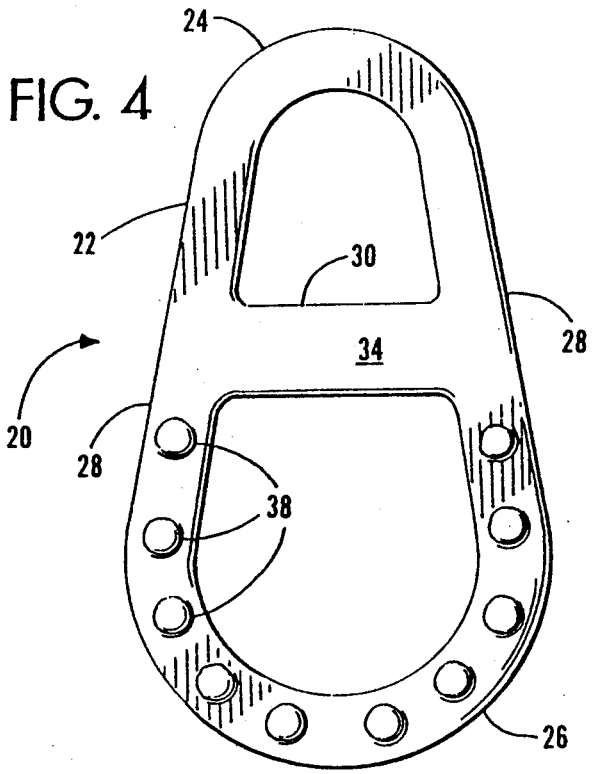

TEETHING BRUSH

FIELD OF THE INVENTION

The present invention relates to toothbrushes in general and to toothbrushes for child and infant use in particular.

BACKGROUND OF THE INVENTION

Typically a child will first visit a dentist or dental hygienist when approximately three years old or older. Yet infants and toddlers are susceptible to tooth decay and gum ailments just as are older children and adults. Even in a toothless infant's mouth plaque is produced in the aerobic fashion. To preserve healthy teeth and gums it is essential to remove plaque as it develops.

Conventional straight-handled toothbrushes formed to child proportions are available which permit plaque to be removed by mechanical means. Such toothbrushes may be effective if used by an adult on the infant or child, but are too difficult to manipulate for an infant and present dangers of injury to an unsupervised toddler. The narrow, stiff handle of a conventional toothbrush permits the brush head and handle to be inserted entirely into the mouth of the child, possibly resulting in the lodgement of the brush in the child's throat or otherwise causing damage to the child's mouth. Because of these possible dangers a child may not safely be permitted to utilize the conventional toothbrush unsupervised, particularly while walking, playing or falling.

Toothbrushes having graspable ringlike handles with outwardly extending horizontal brush head are known which make manipulation by younger children possible, but these brushes still present the dangers of over-insertion into the child's mouth.

Chewable teething rings to assist teething children are known, but these do not contribute to the removal of plaque from a child's teeth and gums.

What is needed is a single implement that may be used safely and without supervision by infants and young children and which will assist tooth eruption and removal of plaque.

SUMMARY OF THE INVENTION

The toothbrush for a child of this invention has a body in the shape of a closed ring with a forward curved portion dimensioned to fit within a child's opened mouth. The body has a rearward curved portion which is wider than a child's opened mouth so as to prevent the body from being inserted fully into a child's mouth. The rearward curved portion forms a handle for gripping by a child. A brush head formed of a plurality of upstanding flexible bristles extends from the forward curved portion of the body. The brush head is preferably curved to conform to the curve of the forward body portion. To facilitate teething a plurality of protruding teething bumps may be located on the rearward portion of the body for biting engagement with the child's teeth and gums.

It is an object of the present invention to provide a child's brush which may be safely employed by an infant or toddler without danger of lodging within the throat.

It is a further object of the present invention to provide a child's brush which effectively removes plaque from the gums and teeth of a child.

It is another object of the present invention to provide a combination child's toothbrush and teething ring.

It is a still further object of the present invention to provide a toothbrush for the unsupervised use of young children.

Further objects, features, and advantages of the invention will be apparent from the following detailed description when taken in conjunction with the accompanying drawings.

BRIEF DESCRIPTION OF THE DRAWINGS

In the drawings:

FIG. 1 is a top plan view of the teething brush of this invention.

FIG. 2 is a side elevational view of the teething brush of FIG. 1.

FIG. 3 is a fragmentary cross-sectional view of the teething brush of FIG. 1 taken along cross-sectional line 3—3.

FIG. 4 is a bottom plan view of the teething brush of FIG. 1.

FIG. 5 is a fragmentary top plan view of an alternative embodiment of the teething brush of this invention.

DESCRIPTION OF THE PREFERRED EMBODIMENT

Figure 6:
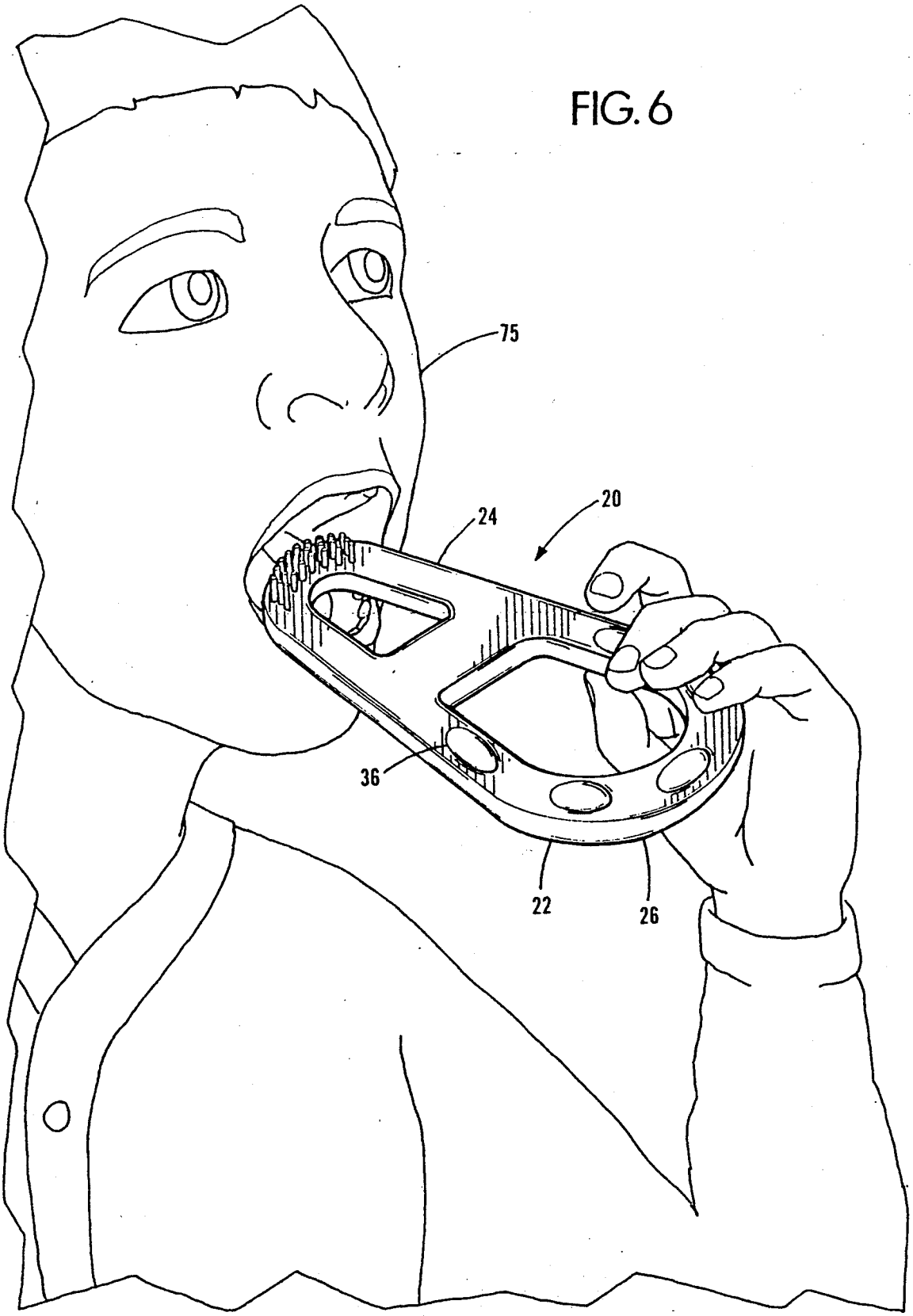
FIG. 6 is an isometric view of the teething brush of FIG. 1 in use by a child.

Referring more particularly to FIGS. 1–6 wherein like numbers refer to similar parts, a teething brush 20 is shown in FIGS. 1–4 and 6. The teething brush 20 is preferably formed of injection molded plastic and has a body 22 which is generally in the shape cf a closed ring. The ring preferably has a smoothly curved perimeter but may be polygonal. The body has a forward curved portion 24 and a rearward curved portion 26 connected by spaced angled side members 28. A cross member 30 is integrally formed with the body 22 and extends between the two side members 28. As best shown in FIG. 6, the forward curved portion 24 is dimensioned to fit within a child's opened mouth. The rearward curved portion 26 is wider than a child's opened mouth so as to prevent the body 22 of the teething brush 20 from being inserted fully into a child's mouth. The rearward curved portion 26 provides a convenient handle for gripping by the small hand of a child. The teething brush 20 thus has the overall shape of a blunted flattened wedge. Because of this shape the further the brush 20 is inserted into a child's mouth the wider the brush becomes. Well before the brush has been inserted far enough into the child's mouth to be potentially harmful, the brush is blocked from further insertion by the narrowness of the child's mouth.

A number of oval protrusions extend from the top surface 32 of the body 22 and form upper teething bumps 36 on the rearward portion 26 of the teething brush 20. On the opposite side of the teething brush 20 smaller protrusions extend from the bottom surface 34 to form additional teething bumps 38, as best shown in FIG. 4. The protruding teething bumps act to blanch the gum tissue when bitten by a teething child, thus soothing the pains associated with teething. The larger and smaller bumps on opposite sides of the body 22 provide alternative textures and feelings which may be easily selected by the user.

A brush head 42 is located on the forward curved portion 24 of the teething brush 20 and is best shown in FIGS. 1 and 2 The brush head 42 is comprised of rows 44 of tufts of flexible bristles 46 which extend from the top surface 32 of the teething brush 20. The brush head 42 preferably is composed of soft multi-tufted and even bristles 46 and has a generally flat top surface. In a preferred embodiment, the brush head has three rows 44 which are curved to conform to the curve of the forward curved portion 24 of the body 22 and are spaced evenly from the perimeter of the forward portion 24. Because of the curved shape of the brush head 42, more tufted bristles 46 may be placed on the outer radius of the brush head 42 than on the inner radius as illustrated in FIGS. 1, 2 and 6. Alternatively, as shown in FIG. 5, a teething brush 120 has a forward portion 124 with a curved brush head 142 with three rows 144 having an identical number of tufted bristles 146 such that the bristles are aligned in even radial pattern. The bristles 46 of the teething brush 20 are embedded in a conventional manner in the plastic of the body 22 to permit flexing of the bristles 46 while being securely retained on the teething brush 20.

The use of the teething brush 20 is illustrated in FIG. 6. A child 75, who typically may be as young as three months old or as old as four years, grips the rearward curved portion 26 of the teething brush 20 in either hand and inserts the forward portion 24 and brush head 42 into his mouth.

The body 22 is formed with curved and rounded edges so that no sharp angles are presented to the child's soft tissue which might cause damage. The cross member 30 divides the body 22 into two enclosed areas one larger than the other. The cross member 30 is positioned more closely to the forward portion of the brush, making it easier for a child to grip the rearward portion 26 and facilitating the correct insertion of the brush head 42 into the child's mouth. Typically, a child's mouth will be no wider than 1½ inches and approximately 2 inches in depth. An exemplary teething brush 20 would have a forward curved portion approximately 1¼ inch wide with a rearward curved portion approximately 1¾ inch wide. This rearward portion is thus larger than the maximum width of a child's mouth. The side members 28 space the forward portion 24 from the rearward portion 26 approximately 3½ inches in a preferred embodiment. Because the brush head 42 is curved along the body 22, there is no protruding narrow member which would present a danger of trauma to the child's throat or mouth. Furthermore, as the teething brush 20 is inserted and withdrawn from the child's mouth, all the bristles 46 are presented to the child's gums and teeth. The curved shape enables a greater number of bristles to be presented than would be possible with a linear brush head of a similar width.

The teeth of small children have grooves on the top. These grooves, pits, or fissures provide areas where food particles may become trapped and where plaque may build up. The orientation of the brush head 42 on the teething brush 20 will promote brushing of these grooves when the child inserts the flat ring body 22 into his mouth. Because of the width of the forward curved portion 24 it is not possible for the child to turn the brush sideways and still insert it into his mouth. This natural orientation of the teething brush 20 will ensure that the top surfaces of the child's teeth will be presented to the brushing action of the teething brush bristles 46. Furthermore, as the brush head enters and leaves the child's mouth, the sides of the front teeth will also be brushed.

To Promote good habits of oral hygiene, it is desirable to encourage in children, even of very young age, the practice of frequent brushing. The teething brush 20, because its dimensions avoid the danger of injury to the child, may be left with the child to chew or suck upon without any supervision required.

Small children who are not amenable to instruction in proper toothbrush use may nonetheless utilize the teething brush 20 with no instruction whatsoever. The ring-like shape provides a natural gripping area for the child's small fingers, and the dimensions of the teething brush 20 permit the brush head 42 to be inserted into the child's mouth in only two orientations, with the bristles 46 pointed upwards or downwards—orientations conducive to effective brushing of the teeth.

A teething child will have a natural tendency to place objects in his mouth and to bite down upon them. Merely presenting the infant with the teething brush will be sufficient to initiate the infant's use cf the article. The soothing effect of the protruding bumps located along the rearward portion of the body will encourage the infant to continue use of the teething brush 20. As the rearward portion is too wide to fit fully into a child's mouth, a child can only chew along the sides of the teething brush 20 while holding the opposite side or the forward curved portion.

The teething brush 20 may be effectively used by an infant prior to the eruption of his teeth. First, the bristles of the brush 42 work to remove plaque from the infant's gums as well as to improve circulation by massaging the gums. Secondly, the teething bumps 36, 38 provide hard areas which may be pressed against the gums when the infant bites down so that the cusp tips of the unerupted teeth can bite into the bumps to assist in forcing the teeth through the soft tissue of the gums. It is especially important that plaque be removed from teeth even as they erupt. If plaque is left on the teeth for an extended period of time it will result in cavities along the areas where soft tissue meets the tooth.

Once a child's teeth have fully erupted and he has developed sufficient manual dexterity and responsibility he may be advanced to the use of a conventional straight-handled toothbrush. However, use of the teething brush 20 will have accustomed the child to regular brushing which will make the transition to a conventional toothbrush easier.

It should be noted that the teething brush of this invention may be fabricated with a greater or lesser number of teething bumps of varying shapes and dimensions and that the brush head may have more or fewer tufted bristles in varying effective arrangements. The body may be formed of a stiff plastic or alternatively may be a resilient material. The forward and rearward portions of the brush body are preferably in the form of simple curves as shown, but consistent with the overall wedge shape of the teething brush these curves may be more nearly flat or compound as desired.

It is understood that the invention is not confined to the particular construction and arrangement of parts herein illustrated and described, but embraces such modified forms thereof as come within the scope of the following claims.

I claim:

1. A toothbrush for a child comprising:

a) a body in the shape of a closed ring having a top surface defining a plane and a first curved portion which forms a portion of the ring and which is dimensioned to fit within a child's opened mouth and a second curved portion wider than a child's opened mouth so as to prevent the body from being inserted fully into a child's mouth, the second curved portion forming a handle for gripping by a child; and b) a plurality of upstanding bristles extending from the plane of the top surface of the first curved portion of the body, the bristles arrayed to generally conform to the curve of the body first curved portion, said bristles and first curved portion defining a brush head.

2. The child's toothbrush of claim 1 further comprising a plurality of protrusions extending from the plane of the top surface of the second portion of the body to form teething bumps for biting engagement with a child's teeth and gums.

3. The child's toothbrush of claim 2 wherein the body has a lower surface with a plurality of protrusions extending from the lower surface away from the top surface protrusions.

4. The child's toothbrush of claim 3 wherein the lower protrusions are smaller than the upper protrusions.

5. The child's toothbrush of claim 1 wherein the body has spaced sides which extend between the first and second portions, and a cross member is integral with the body and extends between and connects the spaced sides.

6. A toothbrush for a child comprising:

a) a body in the shape of a ring having a top surface defining a plane, a first curved portion, which forms a portion of the ring, a second curved portion and two spaced side members joining the first portion to the second portion; and b) a plurality of upstanding flexible bristles extending from the plane of the top surface of the first curved portion, said bristles and first curved portion defining a brush head, the brush head being curved to conform to the curve of the forward body portion.

7. The child's toothbrush of claim 6 wherein a plurality of protrusions extend from the top surface of the second portion of the body to form teething bumps for biting engagement with a child's teeth and gums.

8. The child's toothbrush of claim 6 wherein a cross member is integrally formed with the body and extends between the spaced side members.

9. A combination child's toothbrush and infant teething ring comprising:

a) a body in the shape of a closed ring having a narrow first portion dimensioned to fit within a child's opened mouth, a second portion wider than a child's opened mouth so as to prevent the body from being inserted fully into a child's mouth and two spaced angled side members extending between and connecting the first and second portions, wherein the body has an upper surface defining a plane and a lower surface;

b) a plurality of upstanding bristles extending from the plane of the upper surface in spaced rows along the first portion of the body wherein the rows are evenly spaced from the perimeter of the first body portion, said bristles and first portion defining a brush head; and c) a plurality of protrusions extending from the upper surface of the second portion of the body to form teething bumps for biting engagement with the child's teeth and gums.

10. The combination child's toothbrush and teething ring of claim 9 wherein the first portion is in the shape of a simple curve and the rows of bristles are curved to conform to the curve of the first portion.

* * * * *